US006756745B1

(12) United States Patent
Lin et al.

(10) Patent No.: US 6,756,745 B1
(45) Date of Patent: Jun. 29, 2004

(54) FOUR-ELECTRODE FLUORESCENT LAMP AND THE CIRCUIT FOR ARRANGING THE SAME

(76) Inventors: Tieng-Fu Lin, P. O. Box 487, Chang-Hua (TW), 500; Eongen Yan, P.O. Box 487, Chang-Hua (TW), 500

( * ) Notice: Subject to any disclaimer, the term of this patent is extended or adjusted under 35 U.S.C. 154(b) by 0 days.

(21) Appl. No.: 10/397,804

(22) Filed: Mar. 27, 2003

(51) Int. Cl.[7] ..... H05B 41/16; H01J 13/46
(52) U.S. Cl. ..... 315/265; 315/58; 315/64
(58) Field of Search ..... 315/265, 56, 64, 315/46, 49, 66, 291, 326

(56) References Cited

U.S. PATENT DOCUMENTS 4,329,622 A * 5/1982 Corona et al. ..... 315/49
6,100,638 A * 8/2000 Shah ..... 315/59
6,600,272 B2 * 7/2003 Matsui et al. ..... 315/246

* cited by examiner

*Primary Examiner*—Wilson Lee
*Assistant Examiner*—Thuy Vinh Tran

(57) ABSTRACT

A four-electrode fluorescent, lamp having four filaments in a fluorescent lamp; each of the filament having two leads for being connected to a positive and a negative electrodes of a power source. A resistor is serially connected between a lead of one selective filament and a lead of another selective filaments. Each of the filaments is controlled by a transistor. A pair of capacitors are used to adjust the switching current of a pair of two transistors. The base of the transistor is connected to a respective diode set through a current limiting resistor. Each of the transistor is connected to a diode set. The four diodes are serially connected as a loop with two ends of the loop being connected to two ends of an AC power source. Thereby, a circuit for an alternative lighting four-electrode fluorescent lamp is formed.

5 Claims, 2 Drawing Sheets

FOUR-ELECTRODE FLUORESCENT LAMP AND THE CIRCUIT FOR ARRANGING THE SAME

FIELD OF THE INVENTION

The present invention relates to a four-electrode fluorescent lamp, and particularly to a circuit for an alternative lighting four-electrode fluorescent lamp.

BACKGROUND OF THE INVENTION

In the prior art designs, fluorescent lamps have two Electrodes with each end of the lamp tube having one electrode and a simple circuit design. In actuation, the current consumed is large and vibration of illumination is great so that surge waves and noises generate to make uneasy feeling to uses. Moreover, in prior art design, an igniter is necessary. In starting process, flashing light generates go as to harm eyes of users.

Moreover, the cores of the lamps made of silicon steel or carbon iron powders as a hysteresis transformer which is heavy and generates magnetic fields and noises. Further, high frequency ignition is harmful to human, and particularly to hearing comprehension and brains. The medical instruments and aerospace surveillance systems will be interfered.

SUMMARY OF THE INVENTION

Accordingly, the primary object of the present invention is to provide a four-electrode fluorescent lamp having four filaments in a fluorescent lamp wherein each of the filament has two leads for being connected to a positive and a negative electrodes of a power source. A resistor is serially connected between a lead of one selective filament and a lead of another selective filament. Each of the filament is controlled by a transistor. A pair of capacitors are used to adjust the switching current of a pair of two transistors. The base of the transistor is connected to a respective diode set through a current limiting resistor. Each of the transistor is connected to a diode set. The four diodes are serially connected as a loop with two ends of the loop being connected to two ends of an AC power source. Thereby, a circuit for an alternative lighting four-electrode fluorescent lamp is formed.

The various objects and advantages of the present invention will is be more readily understood from the following detailed description when read in conjunction with the appended drawing.

DETAILED DESCRIPTION OF THE PREFERRED EMBODIMENTS

Figure 1:
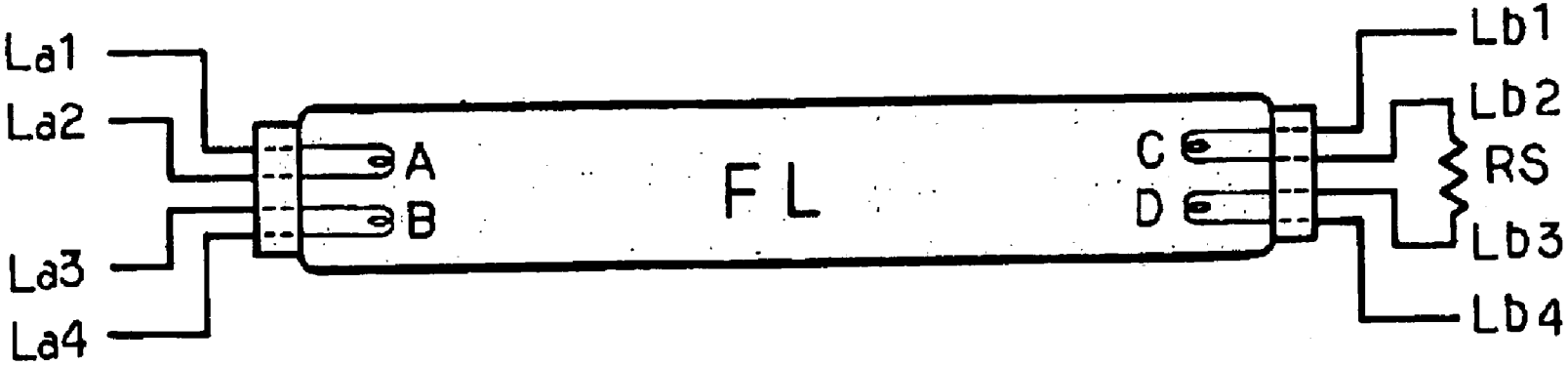
FIG. 1 is a schematic view of the four-electrode fluorescent lamp of the present invention.

Referring to FIG. 1, a first embodiment of the present invention is illustrated. A four-electrode fluorescent lamp FL is illustrated. There are four filaments A, B, C, and D in the four-electrode fluorescent lamp FL, each of the filament A, B, C, D is used as an electrode. The La1 and La2 are leads of the filament A. The La3 and La4 are leads of the filament B. The Lb1 and Lb2 are leads of the filament C. The Lb3 and Lb4 are leads of the filament D. A resistor Rs is serially connected between the leads Lb2 and Lb3.

Figure 2:
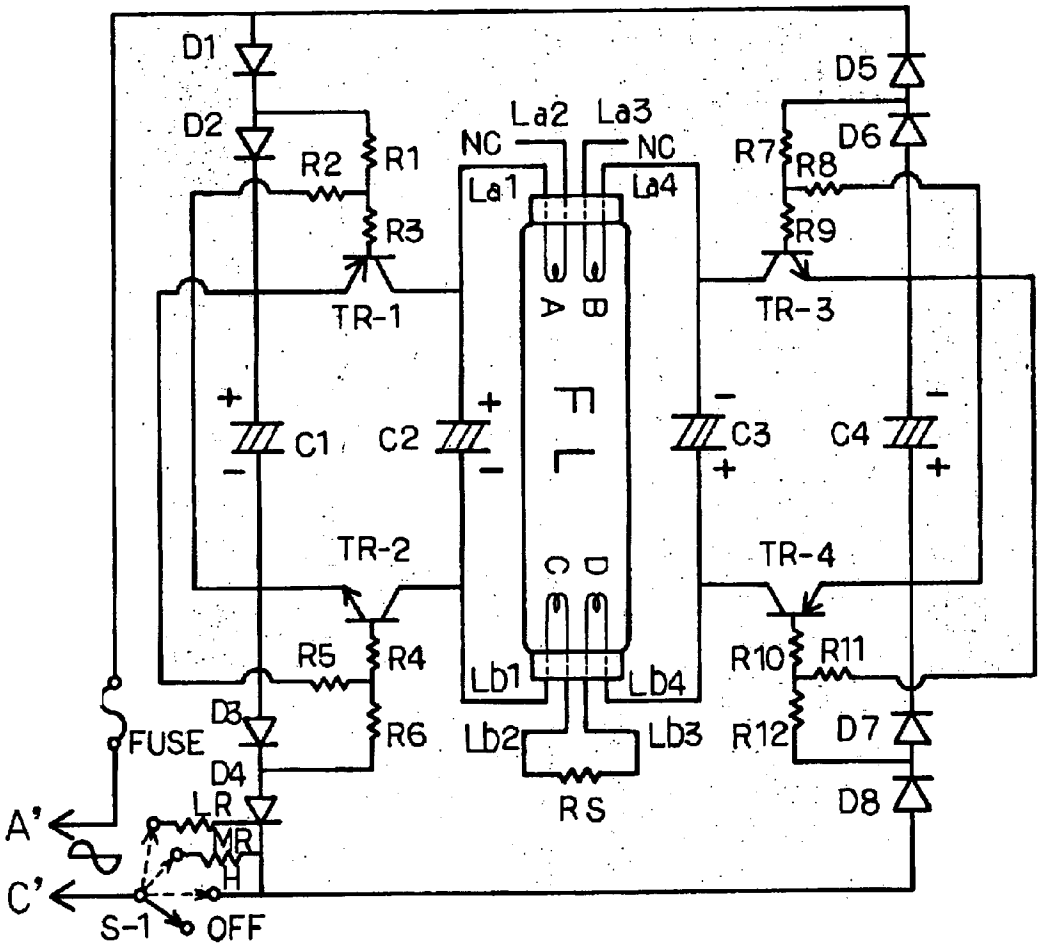
FIG. 2 shows the circuit arrangement of the four-electrode fluorescent lamp of the present invention.

Referring to FIG. 2, another embodiment of the present invention is illustrated. The same elements of the four-electrode fluorescent lamp FL both in FIGS. 1 and 2 are numerated with the same numbers and thus the details wilt not be described herein. It is illustrated that the four electrode fluorescent lamp FL of the present invention is arranged in the electronic circuit. One lead of each of the two electrodes A, and D is connected to a collector of a respective PNP transistor TR-1 and TR-4 and one lead of each of the two electrodes B, and C is connected to a collector of a respective NPN transistor TR-2 and TR-3. The transistors TR-1, TR-2, TR-3 and TR-4 are used as switches for turning on or off the respective leads.

The capacitors C1, C2, C3 and C4 serve to store charges and charge the respective transistors so as to actuate the respective transistors. The capacitor C1 is connected between the emitters of the transistors TR-1 and TR-2, and the capacitor C2 is connected between the collectors of the transistors TR-1 and TR-2. The capacitor C4 is connected between the emitters of the transistors TR-3 and TR-4, and the capacitor C3 is connected between the collectors of the transistors TR-3 and TR-4. The base of transistor TR-1 is connected to the emitter of the transistor TR-2. Thee base of transistor TR-2 is connected to the emitter of the transistor TR-1. The base of transistor TR-3 is connected to the emitter of the transistor TR-4. The base of transistor TR-4 is connected to the emitter of the transistor TR-3.

All the diode sets are serially connected as a diode loop, And one end of the loop is connected to an C' end of the power source and another end of the loop is connected to an A' end of the power source.

Each of the transistors TR-1, TR-2, TR-3 and TR-4 is connected to a diode set through current limiting resistors; for example, the transistor TR-1 is connected to diodes D1 and D2 through the resistor R1–R3. The transistor TR-2 is connected to diodes D3 and D4 through the resistor R4–R6. The transistor TR-3 is connected So diodes D5 and D6 through the resistor R7–R9. The transistor TR-4 is connected to diodes D7 and D8 through the resistor R10–R12.

The fuse FUSE serves to as a safety protection of the circuit.

The operation of FIG. 2 will be described here. When the power switch S-1 is in the off point, the power turns off and the four-electrode fluorescent lamp FL turns off.

When the switch S-1 is at H point, the four-electrode fluorescent lamp FL is at high illumination. When the switch S-1 is at MR point, the four-electrode fluorescent lamp FL is at middle illumination. When the switch S-1 is at LR point, the four-electrode fluorescent lamp FL is at low illumination.

For the PNP transistor TR-1, the positive half cycle of the A' end of the AC voltage will conduct the diodes D1 and D2. Since the resistor R1 is smaller than resistor R2, the transistor TR-1 cuts off and thus the electrode A will not conduct. The diodes D1 and D2 cause that the capacitor C-1 is charged. When the voltage of C' end of the AC power source enters into the negative half cycle, the diodes D1 and D2 cut off and the charges in the negative side of the capacitor C1 causes that the transistor TR-1 conducts so that the charges at the positive side of the capacitor C1 flows through transistor TR-1 to charge the capacitor C2 and the lead La1.

For the NPN transistor TR-2, the negative half cycle of the C' end of the AC voltage will conduct the diodes D4 and D3.

Since the resistor R6 is smaller than resistor R5, the transistor TR-2 cuts off and thus the electrode C will pot conduct. The diodes D4 and D3 cause that the capacitor C1 is charged. When the voltage of the C' end in the AC power supply end enters into the positive half cycle, the, diodes D4 and D3 cut off and the charges in the positive side of the capacitor C1 causes that the transistor TR-2 conducts so that the charges at the positive side of the capacitor C1 flows through transistor TR-1 to charge the capacitor C2 and the lead Lb1.

For the NPN transistor TR-3, the negative half cycle of the A' end of the AC voltage will conduct the diodes D5 and D6. Since the resistor R7 is Smaller than resistor R8, the transistor TR-3 cuts off and the electrode B will not conduct. The diodes D5 and D6, cause that the capacitor C4 is charged. When the voltage of the C' end in the AC power supply end enters into the positive half cycle, the diodes D5 and D6 cut off and the charges in the negative side of the capacitor C4 causes that the transistor TR-3 conducts so that the charges at the positive side of the capacitor C3 flows through transistor TR-3 to charge the capacitor C3 and the lead La4.

For the NPN transistor TR-4, the positive half cycle of the C' end of the AC voltage will conduct the diodes D8 and D7. Since the resistor R12 is smaller than resistor R11, the transistor TR-4 cuts off and thus the electrode D will not, conduct, The diodes D8 and D7 cause that the capacitor C4 is charged; When the voltage of the C' end in the AC power supply end enters into the positive half cycle, the diodes D8 and D7 cut off and the charges in the positive side of the capacitor C4 causes that the transistor TR-4 conducts so that the charges at the positive side of the capacitor C4 flows through transistor TR-4 to charge the capacitor C3 and the lead Lb4. When capacitor C1 is charged, the transistors TR-1 and TR-2 cut off. When the capacitor C4 is charged, transistors TR-3 and TR-4 cut off. When transistors TR-1 and TR-2 conducts, the capacitor C2 is charged. When transistors TR-3 and TR-4, the capacitor C3 is charged. When the capacitors C2 and C3 are charged, the positive charges of capacitor C2 is guided to the lead La1 and negative charges of the capacitor C2 is guided to the lead Lb1. The negative charges of the capacitor C3 is guided to the lead La4 and positive charges thereof is guided to the Lb4. Current froth lead Lb4 flows to the lead Lb3 through the filament D. Then the current flows through the resistor Rs, then flow through the filament C to lead Lb1 to the negative polarity of capacitor C2. Thereby, a serial loop is formed. Thereby, the voltage difference between the filament, A and filament B is $2V_0C$. Then electrodes A and B are discharged so as to generate heat (so called cool cathode method) so that the mercury in the lamp will flow greatly. Since the circuit is a serial connected circuit, the temperature of electrodes C and D will increase (so call hot cathode method) so that a great amount of electrons generate. Thereby, the illumination of the lamp is increased and the impedance in the tube is decreased so that the current is increased. Moreover, since the AC power supplies to the circuit by a sequence of C1, C2, C4 and C3. Thereby, the voltages of La1 and Lb1 and voltages of La4 and Lb4 are alternatively changed so that the lamp tube lights up.

Advantages of the present invention will be described hereinafter.

The power of the four-electrode fluorescent lamp is determined by the capacitances of the capacitors.

The Q value is equal to C (capacitance) * V (voltage) which is equal to I (current) * T (time). No igniter, steady hysteresis transformer, and high frequency is required.

The hot and cold cathodes are used to control the time sequence of the power source.

The resistor Rs has a function of adjusting the igniting actuating current so as to protect the electrodes.

The currents are alternatively changed so that the emitting light is softly and warmly.

The capacitance of the capacitor C2 has a value of 0.003 $\mu$F and capacitance of the capacitor C3 has a value of 0.003 $\mu$F which serves as a surge and noise absorber.

The present invention will not be interfered by EM waves or fields.

The material used is simple. Power can be saved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A four-electrode fluorescent lamp having four filaments in a fluorescent lamp; each of the filament having two leads for being connected to a positive and a negative electrodes of a power source; a resistor being serially connected between a lead of one selective filament and a lead of another selective filament.

2. A circuit for an alternative lighting four-electrode fluorescent lamp comprising a four-electrode fluorescent lamp FL; the four-electrode fluorescent lamp FL containing four filaments A, B, C, and D as electrodes; the filament A having leads La1 and La2; the filament B having leads La3 and La4; the filament Q having leads Lb1 and Lb2; and the filament D having leads Lb3 and Lb4; and a resistor Rs being serially connected between the leads Lb2 and Lb3; the circuit comprising:

four transistors TR-1, TR-2 TR-3 and TR-4; wherein one lead of each of the two adjacent electrodes A, and D is connected to a collector of a respective PNP transistor TR-1 and TR-4 and one lead of each of the two electrodes B, and C are connected to a collector of a respective one of two NPN transistors TR-2 and TR-3; the transistors TR-1, TR-2, TR-3 and TR-4 are used as switches for turning on or off the respective leads; a base of the transistor TR-1 is connected to an emitter of the transistor TR-2; a base of transistor TR-2 is connected to an emitter of the transistor TR-1; a base of the transistor TR-3 is connected to an emitter of the transistor TR-4; a base of the transistor TR-4 is connected to an emitter of the transistor TR-3;

four capacitors C1, C2, C3 and C4 for storing charges and charging the respective transistors TR-1, TR-2, TR-3 and TR-4 so as to actuate the respective transistors TR-1, TR-2, TR-3 and TR-4; wherein the capacitor C1 is connected between the emitters of the transistors TR-1 and TR-2, and the capacitor C2 is connected between the collectors of the transistors TR-1 and TR-2; the capacitor C4 is connected between the emitters of the transistors TR-3 and TR-4, and the capacitor C3 is connected between the collectors of the transistors TR-3 and TR-4;

four diode sets; each containing two diodes; the four diode sets being serially connected as a diode loop, and one end of the loop being connected to a C' end of a power source and another end of the loop being connected to A' end of the power source; wherein each of the transistors TR-1, TR-2, TR-3 and TR-4 being connected to a respective diode set through a respective current limiting resistor; namely the transistor TR-1 is connected to diodes D1 and D2 through resistors R1 and R3; the transistor TR-2 is connected to diodes D3 and D4 through resistors R4 and R6; the transistor TR-3 is connected to diodes D5 and D6 through resistor R7 and R9; and the transistor TR-4 being connected to diodes D7 and D8 through resistors R10 and R12.

3. The circuit for an alternative lighting four-electrode fluorescent lamp as claimed in claim 2, wherein a capacitance of each capacitor is adjustable for determining supply currents to the transistors.

4. The circuit for an alternative lighting four-electrode fluorescent lamp as claimed in claim 2, wherein cool cathode way and hot cathode way are used in an actuation of the four-electrode fluorescent lamp.

5. The circuit for an alternative lighting four-electrode fluorescent lamp as claimed in claim 2, wherein capacitance of the capacitor C2 has a value of 0.003 $\mu$F and capacitance of the capacitor C3 has a value of 0.003 $\mu$F which serve surge and noise absorbers.

* * * * *